US005785400A

United States Patent [19]

Grieser et al.

[11] Patent Number: 5,785,400

[45] Date of Patent: Jul. 28, 1998

[54] DUAL DRAWER SLIDE ASSEMBLY

[75] Inventors: Jerry D. Grieser, Archbold; Richard A. Nelson, Napoleon; Gordon D. Schumacher; Thomas B. Warner, both of Archbold; David M. Dietrich, Napoleon, all of Ohio

[73] Assignee: Sauder Woodworking Co., Archbold, Ohio

[21] Appl. No.: 784,412

[22] Filed: Jan. 16, 1997

Related U.S. Application Data

[63] Continuation-in-part of Ser. No. 551,452, Nov. 1, 1995, abandoned.

[51] Int. Cl.[6] ..... A47B 88/00

[52] U.S. Cl. ..... 312/334.12; 312/330.1; 312/348.4

[58] Field of Search ..... 312/330.1, 334.1, 312/333, 334.7, 334.12, 334.14, 334.15, 334.18, 334.44, 334.45, 348.2, 348.4, 348.1

[56] References Cited

U.S. PATENT DOCUMENTS

| | | | |
|---|---|---|---|
| 3,701,577 | 10/1972 | Fischer | 312/334.12 |
| 3,973,814 | 8/1976 | Entrikin . | |
| 4,121,878 | 10/1978 | Lokken . | |
| 4,288,137 | 9/1981 | MacDonald . | |
| 4,440,460 | 4/1984 | Brighoff | 312/348.4 |
| 4,692,035 | 9/1987 | Rock et al. . | |
| 4,927,216 | 5/1990 | Boda | 312/334.12 |
| 5,292,192 | 3/1994 | Lautenschlager . | |
| 5,449,231 | 9/1995 | Lin . | |
| 5,484,198 | 1/1996 | Pilliod | 312/330.1 X |
| 5,490,724 | 2/1996 | Domenig . | |
| 5,634,703 | 6/1997 | Vonier | 312/334.12 |

FOREIGN PATENT DOCUMENTS

| | | |
|---|---|---|
| 24 24 145 | 11/1975 | Germany . |
| 25 18 647 | 12/1976 | Germany . |

OTHER PUBLICATIONS

Brochure entitled "The Catalina Collection, Model #7815, 5–Drawer Chest", Sauder Woodworking Co., Apr. 1995, pp. 1–3 and 10–12.

*Primary Examiner*—Peter M. Cuomo
*Assistant Examiner*—James O. Hansen
*Attorney, Agent, or Firm*—Emch, Schaffer, Schaub & Porcello Co., L.P.A.

[57] ABSTRACT

A dual drawer slide assembly for smooth and safe operation of a drawer in a cabinet. The assembly includes first and second drawer slides each including a drawer rail having a front end and a back end. A wall member extends between the front and back ends. A top member projects inwardly perpendicular to the wall member. A rail lip projects perpendicular to the top member and parallel to the wall member. A bottom member projects inwardly perpendicular to the wall member and parallel to the top member. Each of the first and second drawer slides includes a drawer glide having a first end adjacent the front end and a second end adjacent the back end. A side member extends between the first and second ends. An upper track projects inwardly perpendicular to the side member. The upper track is adjacent the rail lip. A track lip projects downwardly perpendicular to the upper track and parallel to the side member. The track lip is adjacent the wall member. A rail wheel is rotatably mounted adjacent the front end. The rail wheel is adjacent the side member, the upper track and the track lip of the drawer glide. A glide wheel is rotatably mounted adjacent the second end. The glide wheel is adjacent the wall member, the top member, the rail lip and the bottom member of the drawer rail.

17 Claims, 7 Drawing Sheets

DUAL DRAWER SLIDE ASSEMBLY

RELATED APPLICATION

This is a continuation-in-part of U.S. patent application, Ser. No. 08/551,452, filed Nov. 1, 1995, for "DRAWER SLIDE ASSEMBLY", now abandoned.

BACKGROUND OF THE INVENTION

The present invention relates to a drawer slide assembly. More specifically, the invention is directed to a drawer slide assembly for use in the mounting of a drawer in a cabinet or the like.

Drawer slide assemblies are known in the art. These prior art assemblies have a problem with a condition referred to as "racking". Racking occurs when the wheels mounted on the drawer rail and the drawer glide become misaligned as the drawer glide is moved with respect to the stationary drawer rail. This causes the drawer to which the drawer glide is attached to become misaligned with respect to the cabinet in which it is mounted causing the drawer to become stuck and difficult to move. It has also been found that the prior art assemblies can cause a condition known as "cascading" in which the drawers move outwardly from the cabinet when the cabinet is slightly tilted forward. Cascading of the drawers can cause the drawers and the cabinet to which the drawers are mounted to fall on a person resulting in injury. Further, it has been found that there is a need for a drawer slide assembly that is self-closing when the drawer to which the assembly is attached is pushed toward the cabinet in which the drawer is mounted. Finally, there is a need for an improved drawer slide that can be easily and quickly attached to the bottom surface of a drawer.

The present invention eliminates the problems and satisfies the needs identified above. The present invention provides, among other things, a press-on, full-capture, anti-cascading, self-closing drawer slide assembly.

SUMMARY OF THE INVENTION

The present invention is directed to a dual drawer slide assembly. The assembly includes a first drawer slide and a second drawer slide. The first and second slides are mounted on opposed sides of a drawer. The first and second drawer slides each includes a drawer rail having a front end and a back end. A wall member extends between the front and back ends. A top member projects inwardly perpendicular to the wall member. A rail lip projects downwardly perpendicular to the top member and parallel to the wall member. A bottom member projects inwardly perpendicular to the wall member and parallel to the top member.

Each of the first and second drawer slides further includes a drawer glide having a first end adjacent the front end and a second end adjacent the back end. A side member extends between the first and second ends. An upper track projects inwardly perpendicular to the side member. The upper track is adjacent the retaining lip of the drawer rail. A track lip projects downwardly perpendicular to the upper track and parallel to the side member. The track lip is adjacent the wall member.

A rail wheel is mounted adjacent the front end of the drawer rail. The rail wheel is adjacent the side member, the upper track and the track lip of the drawer slide.

A glide wheel is mounted adjacent the second end of the drawer glide. The glide wheel is adjacent the wall member, the top member, the rail lip and the bottom member of the drawer rail.

It is the primary object of the present invention to provide a full-capture dual drawer slide assembly.

It is an important object of the present invention to provide an anti-cascading dual drawer slide assembly.

It is another object of the invention to provide a self-closing dual drawer slide assembly.

It is another object of the invention to provide a press-on dual drawer slide assembly.

Other objects and advantages of the invention shall become apparent upon a review of the accompanying drawings and the following detailed description of the preferred embodiment of the invention.

DETAILED DESCRIPTION OF THE PREFERRED EMBODIMENT

Figure 1:
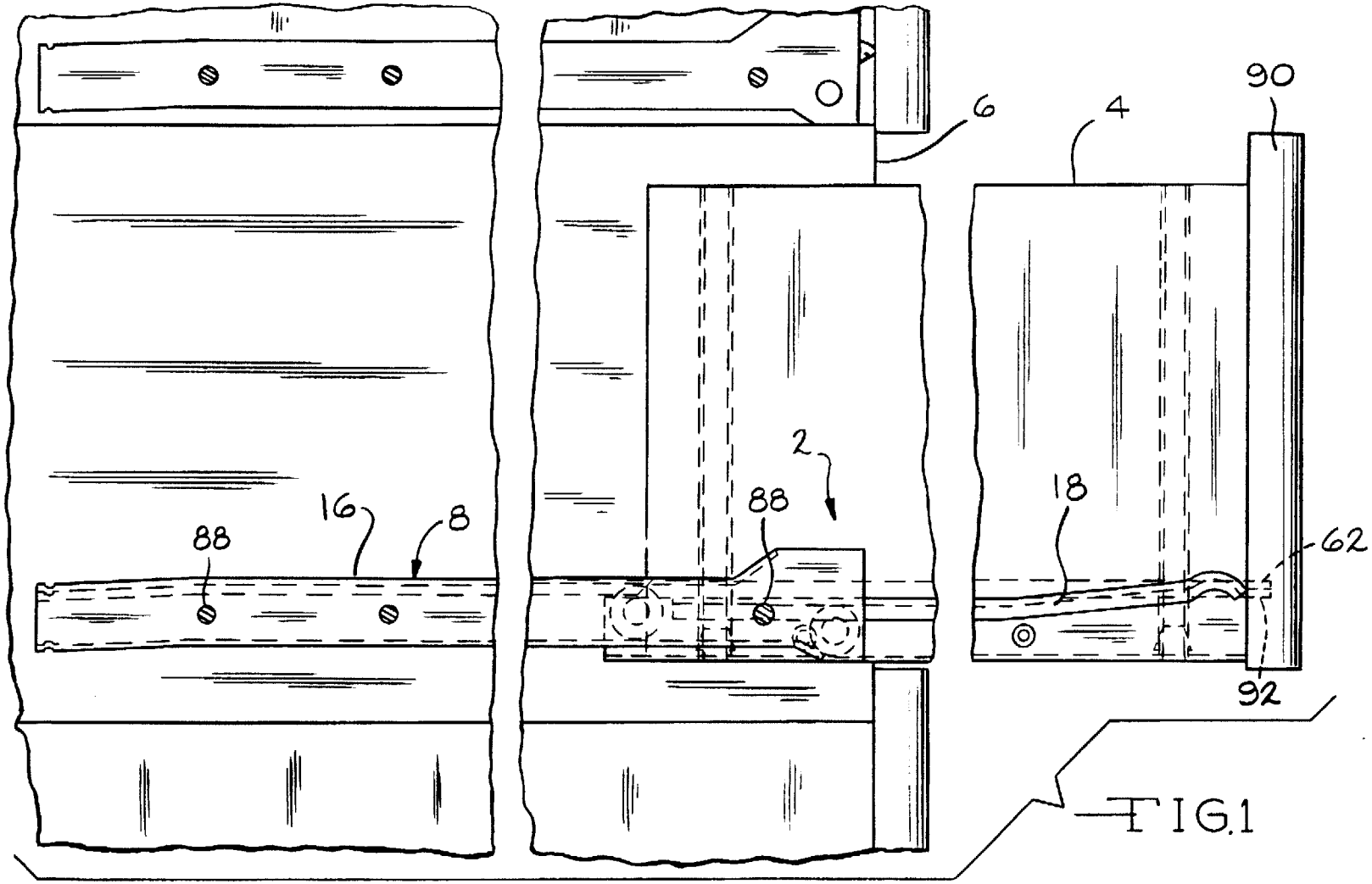
FIG. 1 is side elevational view of the first drawer slide of the present invention mounted to a cabinet and a drawer.
Figure 16:
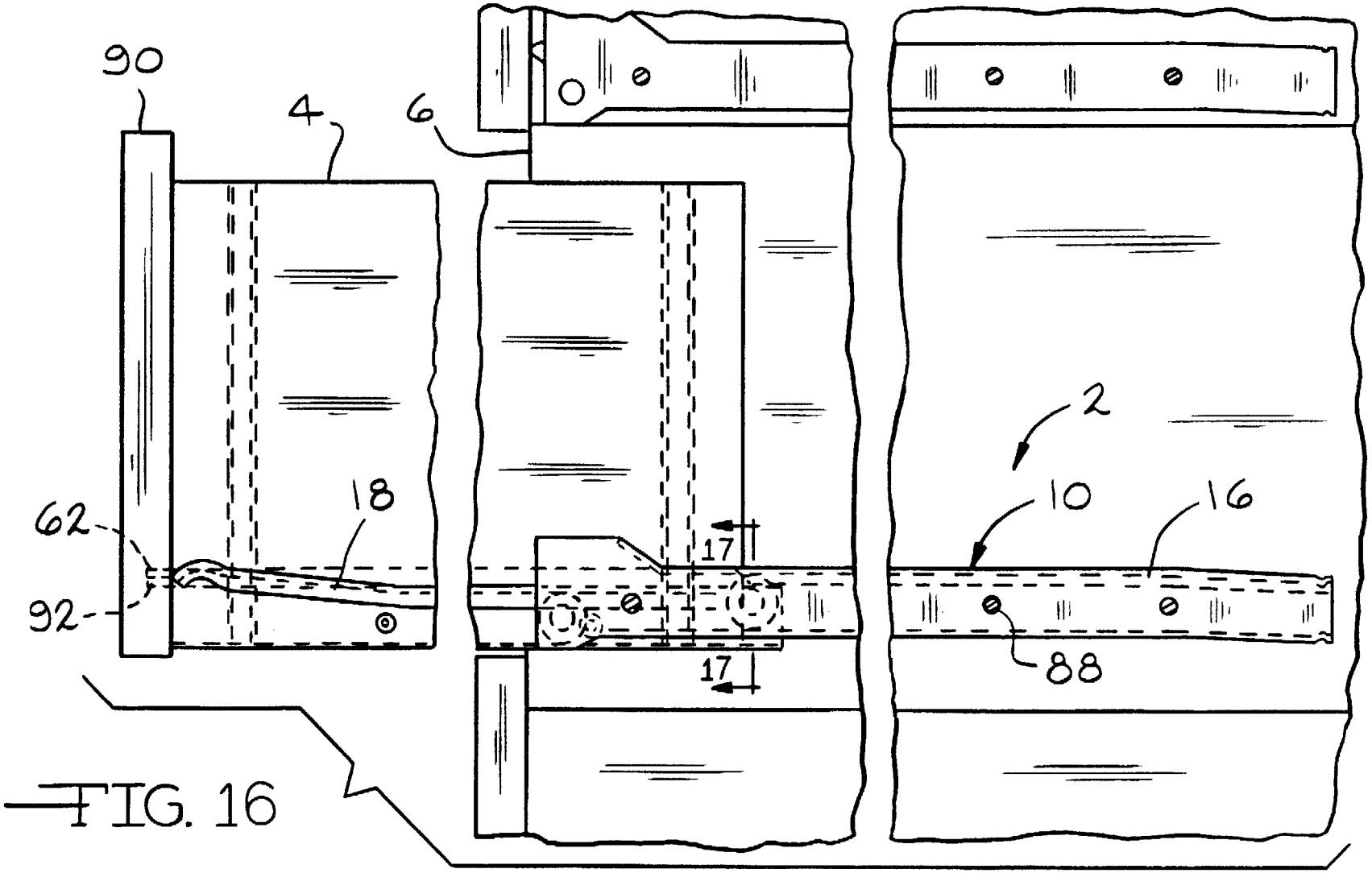
FIG. 16 is a view similar to the view of FIG. 1 showing the second drawer slide of the present invention.
Figure 17:
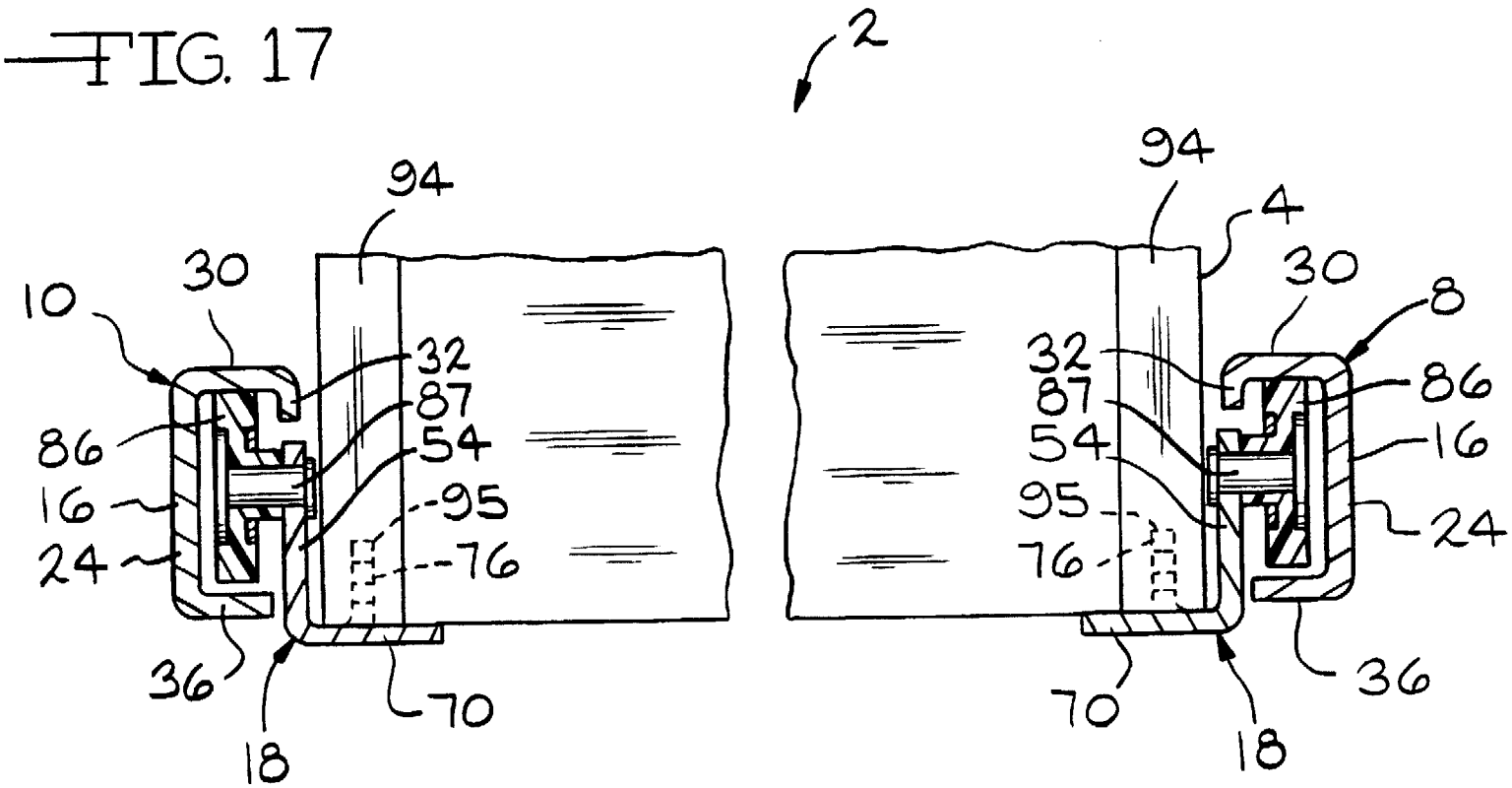
FIG. 17 is a cross-sectional view taken through line 17—17 of FIG. 16.

The preferred embodiment and best mode of the present invention will now be described in detail with reference being made to the accompanying drawings. The dual drawer slide assembly of the present invention is indicated in the drawings by the reference number "2". As shown in FIGS. 1, 16 and 17, the assembly 2 can be used to mount a drawer 4 in a cabinet 6. Generally, the assembly 2 includes a first drawer slide 8 and a second drawer slide 10. Each of the first and second drawer slides includes a drawer rail 16 and a drawer glide 18. The drawer rail 16 is mounted to the cabinet 6. The drawer glide 18 is mounted to the drawer 4.

Figure 10:
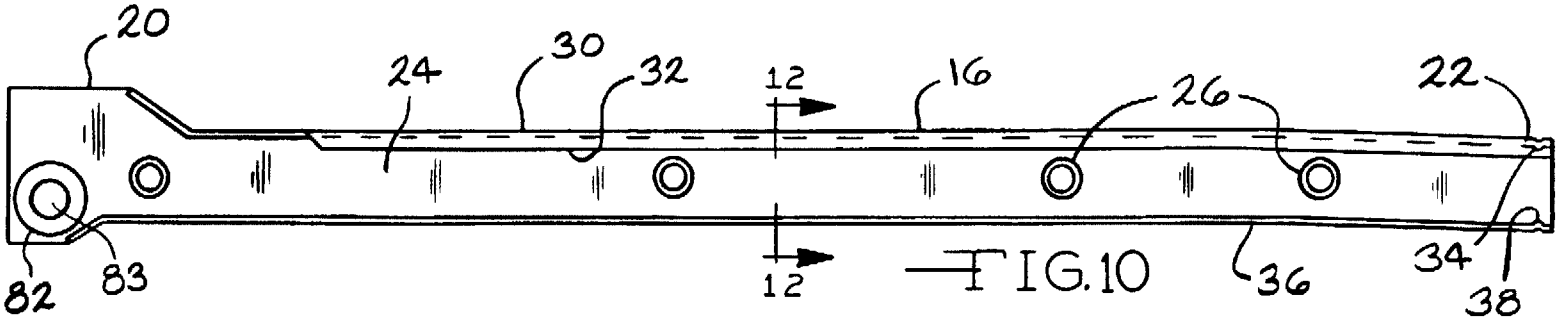
FIG. 10 is a side elevational view of the inside of the drawer rail.
Figure 11:
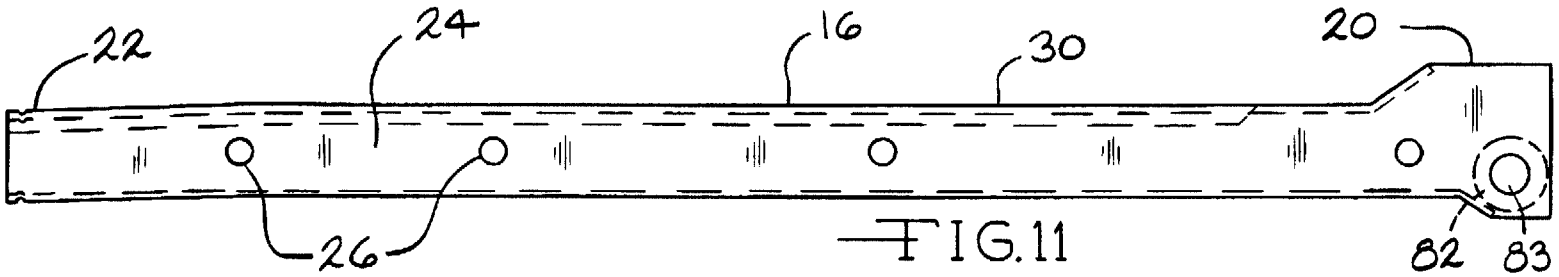
FIG. 11 is a side elevational view of the outside of the drawer rail.
Figure 12:
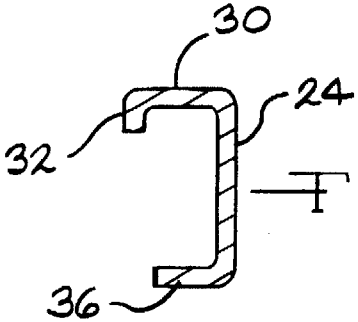
FIG. 12 is a cross-sectional view taken along line 12—12 of FIG. 10.

Referring to FIGS. 10 through 12, each drawer rail 16 has a front end 20 and back end 22. A wall member 24 extends longitudinally between the front end 20 and the back end 22. The wall member defines a plurality of holes 26 that can be used for receiving fastening members, such as threaded screws. The fastening members attach the drawer rail 16 to the cabinet 6. A top member 30 projects inwardly perpendicular to the wall member 24. A rail lip 32 projects downwardly perpendicular to the top member 30 and parallel to the wall member 24. As shown in FIG. 10, the front end 20 of the drawer rail 16 is flared. The top member 30 is also flared adjacent the front end 20. In the flared area adjacent the front end 20, the top member 30 is devoid of the rail lip 32. As described below, the flaring of the front end 20 and the top member 30 will allow for the mounting and dismounting of the drawer glide 18 from the drawer rail 16. Referring still to FIGS. 10 and 11, the top member 30 includes a downwardly projecting top member stop 34 adjacent the back end 22. The drawer rail 16 further includes a bottom member 36 that projects inwardly perpendicular to the wall member 24 and parallel to the top member 30. The bottom member 36 includes an upwardly projecting bottom member stop 38 adjacent the back end 22. The drawer rails 16 can be made of a variety of materials depending on the use of the assembly 2. It has been found that drawer rails comprised of metal are preferred because of the durable qualities of metal.

Figure 13:
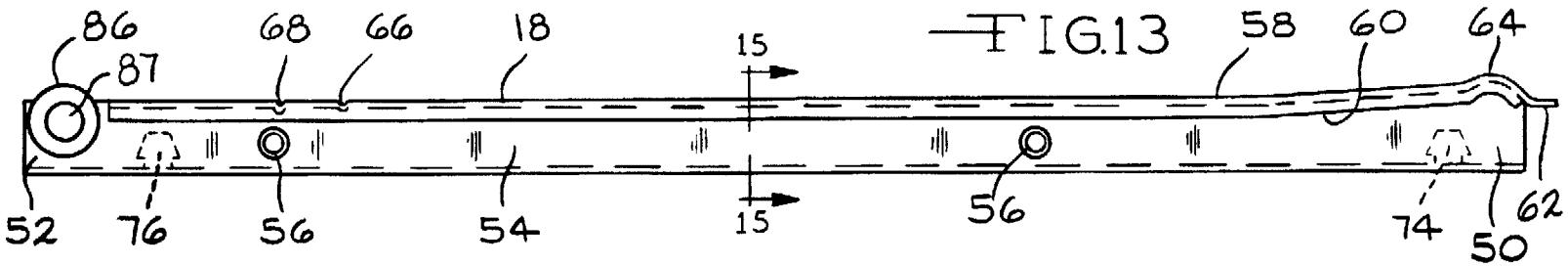
FIG. 13 is a side elevational view of the inside of the drawer glide.
Figure 14:
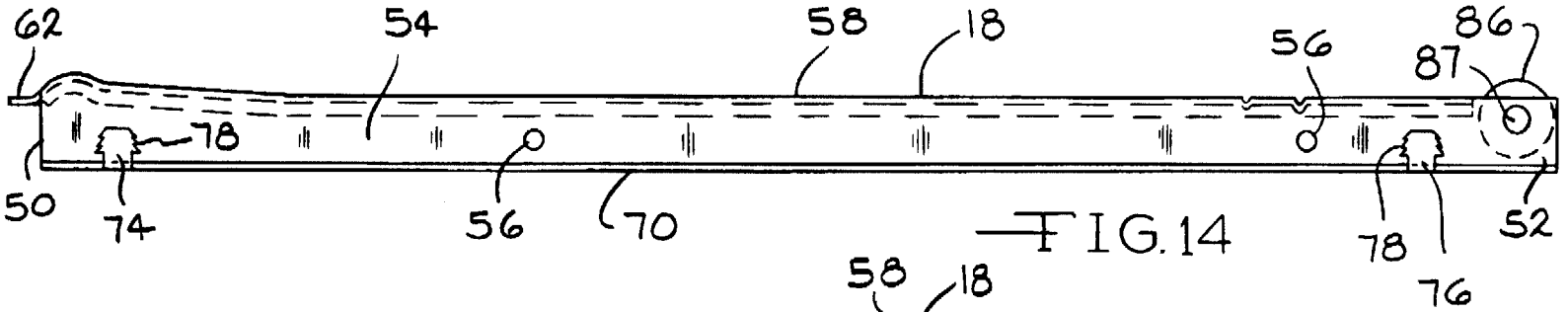
FIG. 14 is a side elevational view of the outside of the drawer glide.
Figure 15:
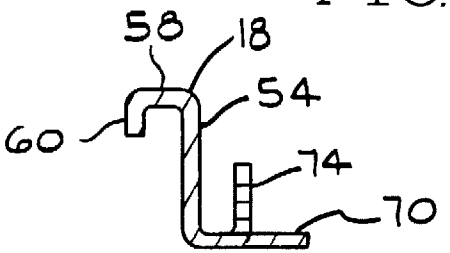
FIG. 15 is a cross-sectional view taken along line 15—15 of FIG. 13.

Referring now to FIGS. 13 through 15, each drawer glide 18 of the assembly 2 has a first end 50 and a second end 52. A side member 54 extends between the first end 50 and the second end 52. The side member 54 defines a plurality of holes 56 that can be used for receiving fastening members such as threaded screws to attach the side member to the drawer 4. An upper track 58 projects inwardly perpendicular to the side member 54. A track lip 60 projects downwardly perpendicular to the upper track 58 and parallel to the side member 54. The upper track 58 includes a tab insert 62 at the first end 50. As shown in FIG. 13, the first end 50 of the drawer glide 18 is flared. The flaring of the first end 50 places the portion of the upper track 58 that is adjacent the first end 50 on a different plane than the remaining portion of the upper track. The upper track 58 defines a recess 64. As shown in FIG. 13, the upper track 58 includes at least one downwardly projecting upper track stop adjacent the second end 52 of the drawer glide 18. In the present embodiment, there are two upper track stops 66 and 68. As shown in FIG. 14, the drawer glide 18 further includes a drawer support member 70 projecting outwardly perpendicular to the side member 54. The drawer support member 70 can define a plurality of holes for receiving fastening members, such as threaded screws (not shown). Referring to FIGS. 14 and 15, the drawer support member 70 includes at least one insert member. In the present embodiment, there are two insert members 74 and 76. Each of the insert members 74 and 76 projects upwardly perpendicular to the drawer support member 70. The insert members 74 and 76 can include barbs 78. The drawer glides 18 can be made of a variety of materials, with metal being preferred.

As shown in FIG. 10, a rail wheel 82 is rotatably mounted on a pin 83 adjacent the front end 20 of each drawer rail 16. As shown in FIGS. 13 and 17, a glide wheel 86 is rotatably mounted on a pin 87 adjacent the second end 52 of each drawer glide 18. In the preferred embodiment, the rail wheel 82 and the glide wheel 86 are comprised of a plastic material. The rail wheel 82 and the glide wheel 86 to flex, float, or move in response flew forces exerted on the first and second drawer slides 8 and 10 during use. As described below, the flexibility of the rail wheel 82 and the glide wheel 86 helps to minimize the racking problem identified above.

Figure 2:
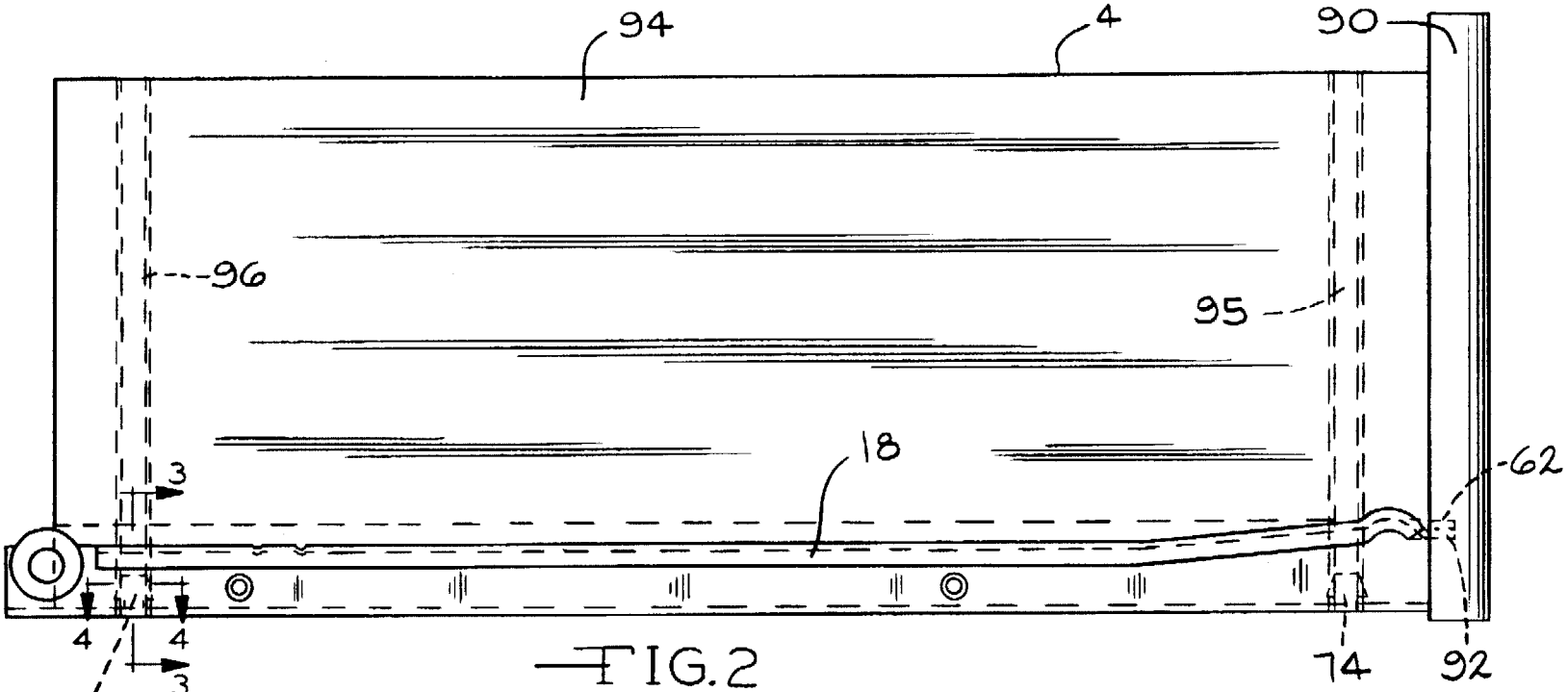
FIG. 2 is a side elevational view of the drawer glide of the present invention mounted on a drawer.
Figure 4:
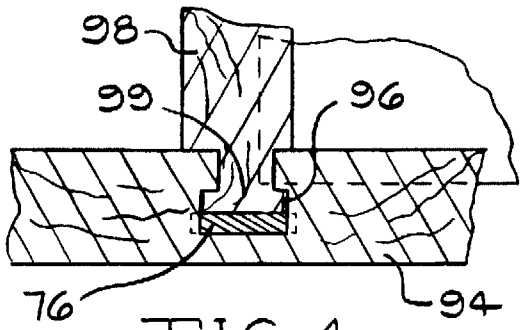
FIG. 4 is a cross-sectional view taken along line 4—4 of FIG. 2.
Figure 3:
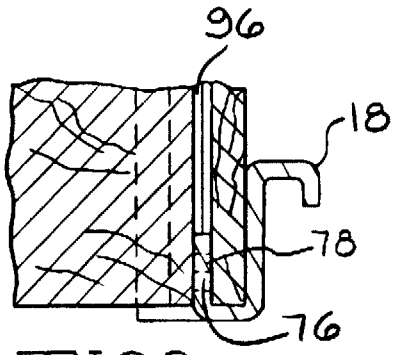
FIG. 3 is a cross-sectional view taken along line 3—3 of FIG. 2.

Each drawer rail 16 is mounted by threaded screws 88 to the inside walls of the cabinet 6 as shown in FIGS. 1 and 16. As shown in FIGS. 2, 3, 16 and 17, each drawer glide 18 is mounted to the side and bottom surfaces of the drawer 4. In the present embodiment, the drawer 4 includes a drawer front 90 having a front slot 92, two drawer side panels 94 each having a first T-slot 95 and a second T-slot 96, and a back panel 98 having T-shaped inserts 99. As shown in FIG. 4, the T-shaped inserts 99 of the back panel 98 are received by the second T-slots 96 of the side panels 94. As shown in FIGS. 2, 3 and 17, each drawer glide 18 is attached to the drawer 4 by sliding the insert members 74 and 76 into the first and second T-slots 95 and 96, respectively. The barbs 78 on the insert members 74 and 76 prevent the members from being easily removed from the T-slots. Threaded screws may be inserted through the holes 56 to secure the drawer glides 18 to the drawer 4. However, it has been found that the insertion of the insert members 74 and 76 into the T-slots 95 and 96, respectively, securely attaches the drawer glides 18 to the drawer 4 without the use of threaded screws.

As shown in FIGS. 1, 2 and 16, the tab insert 62 of each drawer glide 18 is inserted in the front slot 92 of the drawer front 90 to provide for a secure connection between the drawer glides and the drawer 4. This connection prevents the drawer glides 18 and the drawer 4 from falling out of the cabinet 6.

Figures 5, 6, 7, 8, 9:
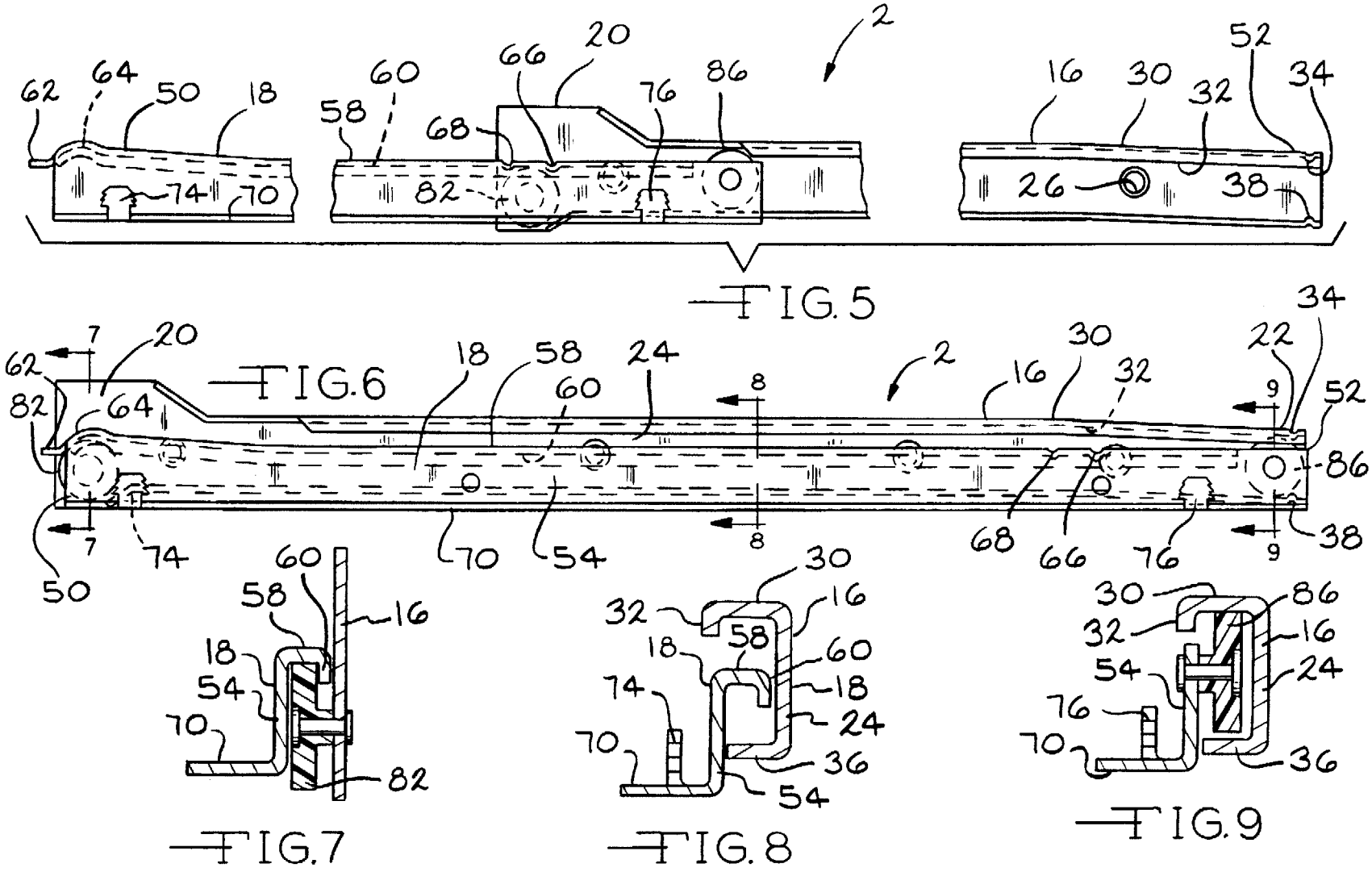
FIG. 5 is a side elevational view of the drawer glide in a fully extended position with respect to the drawer rail.
FIG. 6 is a side elevational view of the drawer slide assembly according to the present invention in which the drawer glide is in the fully retracted position with respect to the drawer rail.
FIG. 7 is a cross-sectional view taken along line 7—7 of FIG. 6.
FIG. 8 is a cross-sectional view taken along line 8—8 of FIG. 6.
FIG. 9 is a cross-sectional view taken along line 9—9 of FIG. 6.

Referring to FIGS. 5 through 9 and 17, the flared portion of the front end 20 of each drawer rail 16 allows the glide wheel 86 to be moved over the rail wheel 82 for the attachment or detachment of the drawer glides 18 from the drawer rails 16. When the drawer glide 18 is fully retracted with respect to the drawer rail 16 as shown in FIG. 6, the first end 50 of the drawer glide 18 is adjacent the front end 20 of the drawer rail 16. The second end 52 of the drawer glide 18 is adjacent the back end 22 of the drawer rail 16. As shown in FIG. 8, the upper track 58 of the drawer glide 18 is adjacent the rail lip 32 of the drawer rail 16. The track lip 60 of the drawer glide 18 is adjacent the wall member 24 of the drawer rail 16. Referring to FIG. 7, the rail wheel 82 is adjacent the side member 54, the upper track 58 and the track lip 60 of the drawer glide 18. Referring to FIG. 9, the glide wheel 86 is adjacent the wall member 24, the top member 30, the rail lip 32 and the bottom member 36 of the drawer rail 16. As shown in FIG. 17, when the drawer rails 16 and the drawer glides 18 of the first and second drawer slides 8 and 10 are positioned as described above, the rail wheels 82 and the glide wheels 86 are fully captured on both sides of the drawer 4. The full capture of the wheels in combination with the flexible rail and glide wheels 82 and 86 prevents the racking problem that is prevalent with prior art drawer slide assemblies. In the present invention, the lateral movement of the rail wheels 82 and the glide wheels 86 is restricted so that the wheels are always in proper alignment. Minor deviations in alignment are overcome by the flexible nature of the rail and glide wheels 82 and 86. This provides for smooth operation of the assembly 2.

As shown in FIG. 6, the undesired forward movement of the drawer glide 18 with respect to the drawer rail 16 is prevented or restricted when the glide wheel 86 engages the top and bottom member stops 34 and 38. The forward movement is also restricted when the rail wheel 82 is received by the recess 64 of the drawer glide 18. The flared first end 50 of the drawer glide 18 causes the rail wheel 82 to roll into the recess 64 thereby causing the drawer slide assembly 2 to be self-closing when the drawer 4 is pushed into the cabinet 6. The engagement of the rail wheels 82 with the recesses 64 also prevents the drawer 4 from cascading out of the cabinet 6 if the cabinet is tipped forward.

As shown in FIG. 5, the undesired backward movement of the drawer glide 18 with respect to the drawer rail 16 is prevented or restricted when the rail wheel 82 engages the upper track stops 66 and 68 of the drawer glide 18. The upper track stops 66 and 68 are spaced so that they conform to the size and shape of the rail wheel 82.

While the invention as been described with reference to a preferred embodiment, it should be understood by those skilled in the art that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

We claim:

1. A dual drawer slide assembly for a cabinet having at least one drawer including a drawer front defining a slot comprising:

a first drawer slide and an opposed second drawer slide each including:

(a) a drawer rail having a front end and a back end, a wall member extending between said front and back ends, a top member projecting inwardly substantially perpendicular to said wall member, a rail lip projecting downwardly substantially perpendicular to said top member and substantially parallel to said wall member, a bottom member projecting inwardly substantially perpendicular to said wall member and substantially parallel to said top member;

(b) a drawer glide having a first end adjacent said front end and a second end adjacent said back end, a side member extending between said first and second ends, an upper track projecting inwardly substantially perpendicular to said side member, said upper track being adjacent said rail lip, a track lip projecting downwardly substantially perpendicular to said upper track and substantially parallel to said side member, said track lip being adjacent said wall member, said upper track including a tab insert for insertion in said slot defined by said drawer front to connect said drawer glide to said drawer front;

(c) a rail wheel mounted adjacent said front end, said rail wheel being adjacent said side member, said upper track and said track lip of said drawer glide; and (d) a glide wheel mounted adjacent said second end, said glide wheel being adjacent said wall member, said top member, said rail lip and said bottom member of said drawer rail.

2. The assembly of claim 1, wherein said wall member of said drawer rail defines a plurality of holes for receiving fastening means for attaching said drawer rail to a surface.

3. The assembly of claim 1, wherein said front end of said drawer rail is flared.

4. The assembly of claim 3, wherein said top member of said drawer rail adjacent said front end is flared, whereby said glide wheel is free to move with respect to said rail wheel.

5. The assembly of claim 1, wherein said top member of said drawer rail includes a downwardly projecting top member stop adjacent said back end for restricting movement of said glide wheel.

6. The assembly of claim 1, wherein said bottom member of said drawer rail includes an upwardly projecting bottom member stop adjacent said back for restricting movement of said glide wheel.

7. The assembly of claim 1, wherein said drawer rail is comprised of metal.

8. The assembly of claim 1, wherein said rail wheel is comprised of a plastic material.

9. The assembly of claim 1, wherein said side member of said drawer slide defines a plurality of holes for receiving fastening means for attaching said drawer slide to a drawer.

10. The assembly of claim 1, wherein said upper track of said drawer glide defines a recess for receiving said rail wheel.

11. The assembly of claim 1, wherein said upper track includes at least one downwardly projecting upper track stop adjacent said second end of said drawer glide for restricting movement of said rail wheel.

12. The assembly of claim 1, wherein said drawer glide includes a drawer support member projecting outwardly substantially perpendicular to said side member.

13. The assembly of claim 12, wherein said drawer support member includes insert means for attaching said drawer glide to a drawer.

14. The assembly of claim 13, wherein said insert means includes at least one barbed insert projecting upwardly substantially perpendicular to said drawer support member.

15. The assembly of claim 1, wherein said drawer glide is comprised of metal.

16. The assembly of claim 1, wherein said glide wheel is comprised of a plastic material.

17. A dual drawer slide assembly for a cabinet having at least one drawer including a drawer front defining a slot comprising:

a first drawer slide for mounting on a first side of said drawer and an opposed second drawer slide for mounting on a second side of said drawer each of said drawer slides including:

(a) a drawer rail having a front end and a back end, a wall member extending between said front and back ends, a top member projecting inwardly substantially perpendicular to said wall member, a rail lip projecting downwardly substantially perpendicular to said top member and substantially parallel to said wall member, a bottom member projecting inwardly substantially perpendicular to said wall member and substantially parallel to said top member;

(b) a drawer glide having a first end adjacent said front end and a second end adjacent said back end, a side member extending between said first and second ends, an upper track projecting inwardly substantially perpendicular to said side member, said upper track being adjacent said rail lip, a track lip projecting downwardly substantially perpendicular to said upper track and substantially parallel to said side member, said track lip being adjacent said wall member, said upper track including a tab insert for insertion in said slot defined by said drawer front to connect said drawer glide to said drawer front;

(c) a floating rail wheel mounted adjacent said front end, said rail wheel being fully captured by said side member, said upper track and said track lip of said drawer glide to prevent said drawer from racking with respect to said cabinet; and (d) a floating glide wheel mounted adjacent said second end, said glide wheel being adjacent said wall member, said top member, said rail lip and said bottom member of said drawer rail to prevent said drawer from racking with respect to said cabinet.

* * * * *